US008459394B2

(12) United States Patent
Storer et al.

(10) Patent No.: US 8,459,394 B2
(45) Date of Patent: Jun. 11, 2013

(54) REAR WHEEL DRIVE ASSIST WITH ARTICULATION BASED SPEED MODULATION

(75) Inventors: Corwin E. Storer, Bartonville, IL (US); Douglas J. Carlton, Peoria, IL (US); Todd M. Weier, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 787 days.

(21) Appl. No.: 12/414,803

(22) Filed: Mar. 31, 2009

(65) Prior Publication Data

US 2010/0023227 A1 Jan. 28, 2010

Related U.S. Application Data

(63) Continuation-in-part of application No. 12/179,186, filed on Jul. 24, 2008, and a continuation-in-part of application No. 12/179,267, filed on Jul. 24, 2008.

(51) Int. Cl.
*B62D 6/00* (2006.01)

(52) U.S. Cl.
USPC ..... 180/237; 701/42; 701/1; 172/9; 172/75

(58) Field of Classification Search
USPC ..... 144/336, 4.1, 34.1; 60/422, 466, 60/427; 180/14.2, 242, 308
See application file for complete search history.

(56) References Cited

U.S. PATENT DOCUMENTS

| | | | | |
|---|---|---|---|---|
| 3,584,698 | A | 6/1971 | Larson et al. | |
| 3,981,374 | A | 9/1976 | Johns, Jr. | |
| 5,682,958 | A * | 11/1997 | Kalhorn et al. | 180/308 |
| 5,884,204 | A * | 3/1999 | Orbach et al. | 701/50 |
| 6,267,163 | B1 * | 7/2001 | Holmes | 144/336 |
| 2006/0266565 | A1 * | 11/2006 | Fontecchio et al. | 180/6.5 |
| 2008/0116000 | A1 * | 5/2008 | Huang et al. | 180/418 |

OTHER PUBLICATIONS

Displacement Change, Poclain Hydraulics, Poclain Hydraulics Training Center, available at http://www.poclain-hydraulics.com/portals/0/self%20training/Changement%20de%20cylindree_GB.pdf.

* cited by examiner

*Primary Examiner* — Tony H. Winner
*Assistant Examiner* — Jacob Knutson
(74) *Attorney, Agent, or Firm* — Michael D. Braunstein

(57) ABSTRACT

A rear wheel drive assist for an articulated machine such as a wheel tractor scraper, the machine including a first frame section having a first longitudinal axis, a second frame section with a second longitudinal axis, the first and second frame sections being pivotally connected to an articulation hitch, and an articulation sensor configured to provide an articulation angle signal indicative of an articulation angle formed between the first and second longitudinal axes. The rear wheel drive assist includes a drive motor operatively connected to the rear wheel of the machine, and a controller configured to control operation of the rear wheel drive assist based upon the articulation angle signal.

20 Claims, 11 Drawing Sheets

REAR WHEEL DRIVE ASSIST WITH ARTICULATION BASED SPEED MODULATION

CROSS-REFERENCE TO RELATED APPLICATIONS

This application is a continuation-in-part of U.S. application Ser. No. 12/179,186, filed on Jul. 24, 2008, and U.S. application Ser. No. 12/179,267, filed on Jul. 24, 2008, the disclosures of which are incorporated herein by reference.

TECHNICAL FIELD

This disclosure relates generally to the art of earth moving equipment and particularly to a fluid operated rear wheel drive assist for an articulated machine with a control system that modulates power to the rear wheel assist based on articulation angle.

BACKGROUND

The wheel tractor scraper is a machine employed in various industries, such as agriculture, construction and mining to load, haul, eject and spread layers of earth. Such machines are particularly suited for applications, for example, in roadway construction and site preparation, where material needs to be removed or added while creating or maintaining grade and hauling occurs over moderate distances, e.g. under one mile. Conventional wheel tractor scrapers typically include a tractor portion having a forward frame member that supports the operator station and a power source operatively coupled to the driven wheels of the machine. An articulated joint couples the tractor portion to the rear scraper portion, the scraper portion having a rear frame member that supports both a bowl for collecting and hauling material, and the rear wheels. During operation, the bowl is typically lowered to engage the ground along a cutting edge that is driven forward by the machine, loading the bowl. Many of these machines will have an earth-moving work tool, such as an elevator, conveyor, auger, or spade, associated with the bowl to facilitate penetration and/or loading of the material to be transported.

One of the limiting factors associated with wheel tractor scraper operations are the traction conditions of the work site. Tractor scraper operations can be limited, for example, by the type of material, geographic location, and seasonal conditions of the work site.

Various improvements and methods of operation have been adopted by the industry to increase the versatility and efficiency of these machines. For example, wheel tractor scrapers are often employed in push-pull operations, wherein a first tractor scraper is either pulled or pushed by a second machine, for example, a track-type dozer or another wheel tractor scraper, during the loading process. Wheel tractor scrapers are often provided with hitches or push bars to facilitate these operations. However, the option of a second machine is not always possible, and this increases operating costs. Further, this does not address concerns of the tractor scraper becoming stuck during the remainder of the work cycle.

As an alternative, some large wheel tractor scrapers are provided with an additional, rear mounted engine operatively connected to drive the rear wheels of the machine (twin-engine scrapers), making these machines better suited for handling adverse terrain and worksite conditions. However, another alternative has been to provide a fluid operated rear wheel assist.

For example, U.S. Pat. No. 5,682,958 to Kalhorn et al. provides a hydrostatic rear wheel assist that includes a reversible variable displacement pump operatively coupled to an engine and mounted to the front frame section of an articulated scraper. The pump is fluidly connected to a pair of motors positioned on the rear frame section for driving the right and left rear wheels, respectively. The pump may be actuated via a floor pedal that controls an engagement/disengagement valve having two positions, an engagement position for directing pressurized fluid to the motors, and a disengagement position for preventing flow to the motors. However, this requires an additional and dedicated fluid pump, fluid lines, and other components that significantly add to overall vehicle complexity and cost.

Another difficulty associated with providing a rear wheel assist for an articulated machine is that as the articulation angle is increased to effectuate a turn, if too much power is supplied to the rear wheels, and the traction of the front driven wheels is insufficient, the machine may be driven forward rather than turning. This may also cause the front end of the machine to "hop" when the front wheels catch or regain traction. The result of both of these conditions is decreased machine control and undesirable stresses that may damage the machine.

In general, the need exists in the industry for wheel tractor scrapers that are capable of efficient operation under a greater range of terrain conditions. In particular, the need exists for an improved rear wheel assist design and efficient methods of operation thereof, and, more particularly, for a rear wheel assist that responds to machine articulation.

SUMMARY OF THE INVENTION

In one aspect, the present disclosure provides an articulated machine, such as a wheel tractor scraper, having a first frame section with a power source drivingly connected to at least one front wheel, and a second frame section having at least one rear wheel, the first and second frame sections being pivotally connected at an articulation hitch. An articulation sensor is configured to provide an articulation signal indicative of an articulation angle formed between longitudinal axes of the first and second frame sections. A rear wheel drive assist is also provided that includes a drive motor operatively connected to the rear wheel of the machine. A controller is configured to control operation of the rear wheel drive assist based upon the articulation signal.

In another aspect, provided is an articulated machine having a first frame section with a power source drivingly connected to at least one front wheel, and a second frame section having at least one rear wheel, the first and second frame sections being pivotally connected at an articulation hitch. An articulation sensor is configured to provide an articulation signal indicative of an articulation angle formed between longitudinal axes of the first and second frame sections. A first speed sensor provides an indication of a front wheel speed, and a second speed sensor provides an indication of rear wheel speed. A rear wheel drive assist is also provided that includes a drive motor operatively connected to the rear wheel of the machine. A controller is configured to control operation of the rear wheel drive assist to reduce the rear wheel speed relative to the front wheel speed based on the articulation signal.

In yet another aspect, provided is a wheel tractor scraper having a tractor portion with a power source drivingly connected to at least one front wheel, and a scraper portion pivotally connected to the tractor portion at an articulation hitch, the scraper portion having a bowl and at least one rear wheel. First and second linear actuators are connected between the tractor portion and the scraper portion in opposed position, the actuators configured to move the tractor portion relative to the scraper portion about the articulation hitch. An articulation sensor is configured to provide an articulation signal indicative of an articulation angle formed between longitudinal axes of the tractor and scraper portions of the machine. A first speed sensor is configured to provide an indication of a front wheel speed, and a second speed sensor is configured to provide an indication of a rear wheel speed. In this embodiment, the rear wheel drive assist includes a fluid pump connected to a drive motor to drive the rear wheel, a controller configured to control operation of the rear wheel drive assist to reduce the rear wheel speed relative to the front wheel speed based on the articulation signal.

These and other aspects and advantages of the present disclosure will become apparent to those skilled in the art upon reading the following detailed description in connection with the drawings and appended claims.

DETAILED DESCRIPTION

Figure 1:
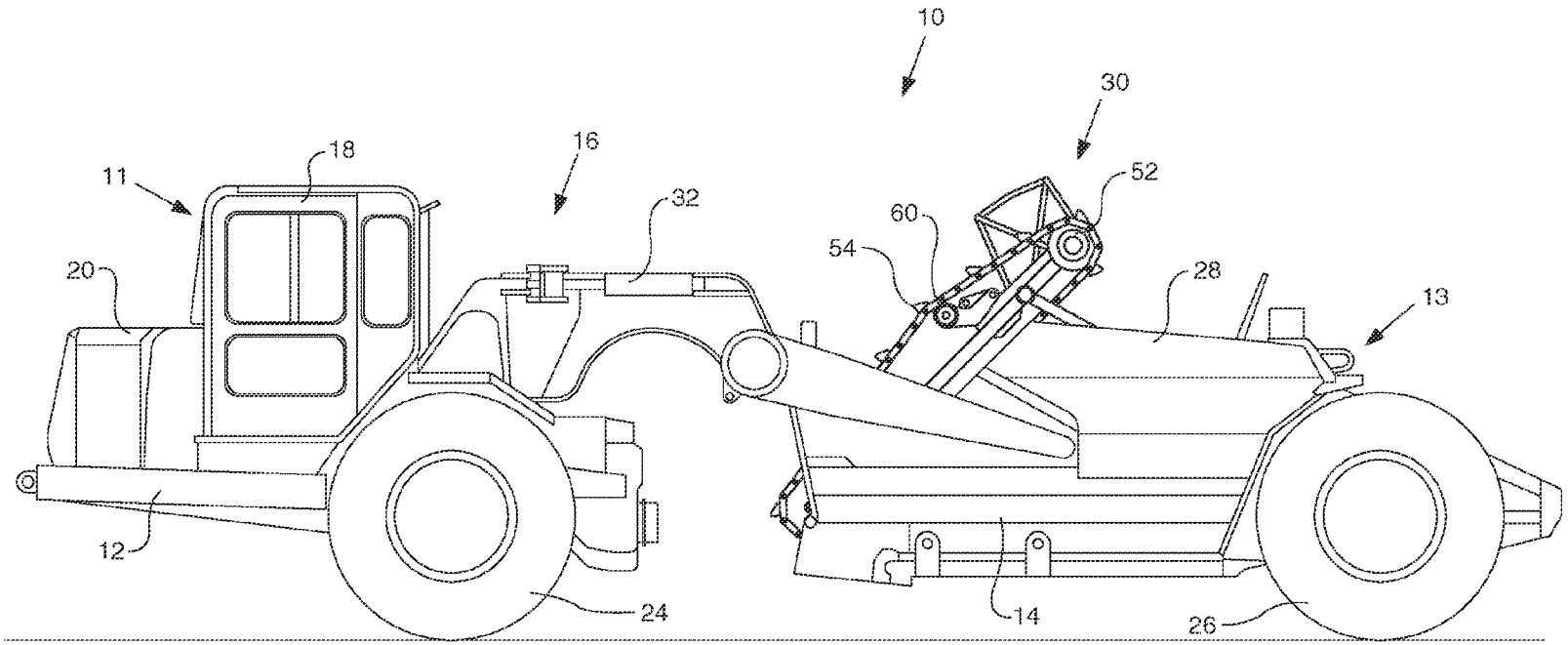
FIG. 1 is a diagrammatic illustration of an exemplary wheel tractor scraper.
Figure 9:
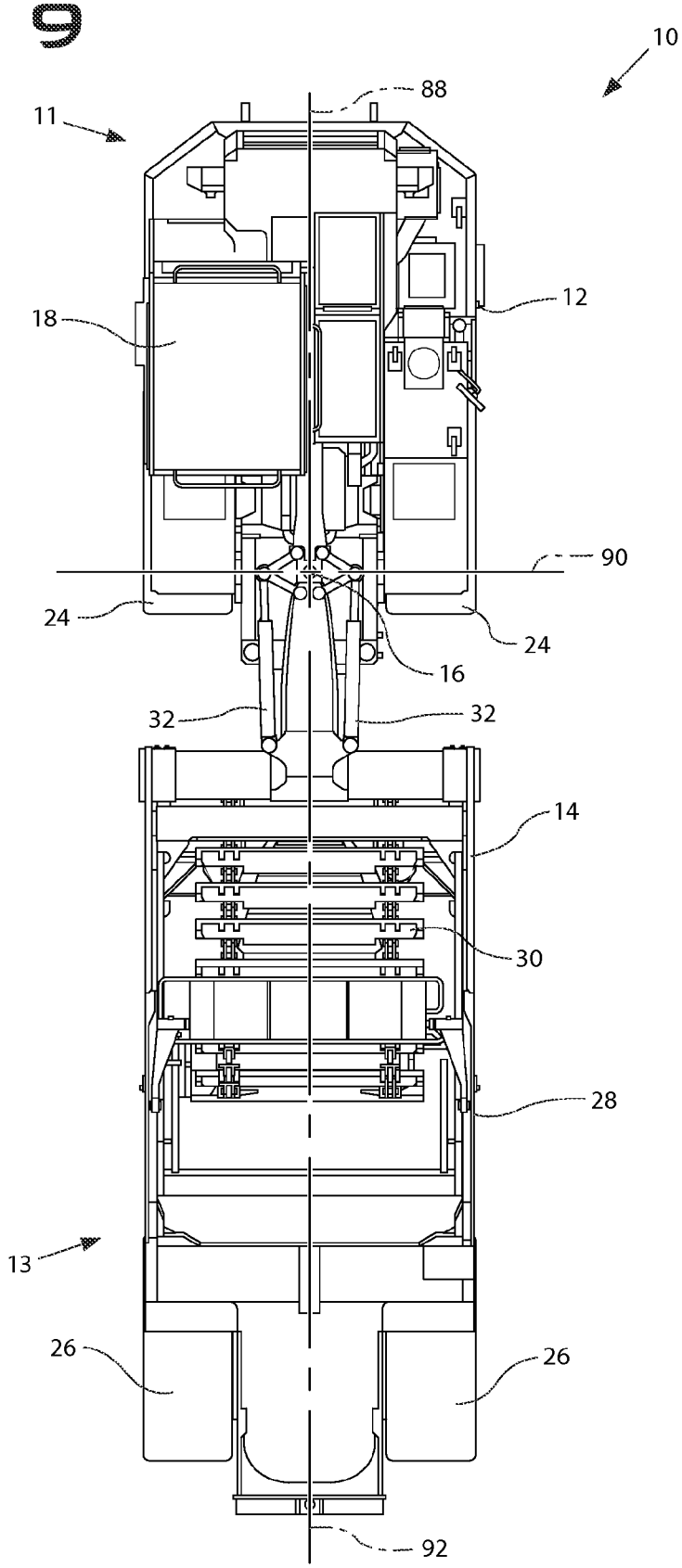
FIG. 9 is a top view of an articulated machine illustrating a range of articulation angles.
Figure 10:
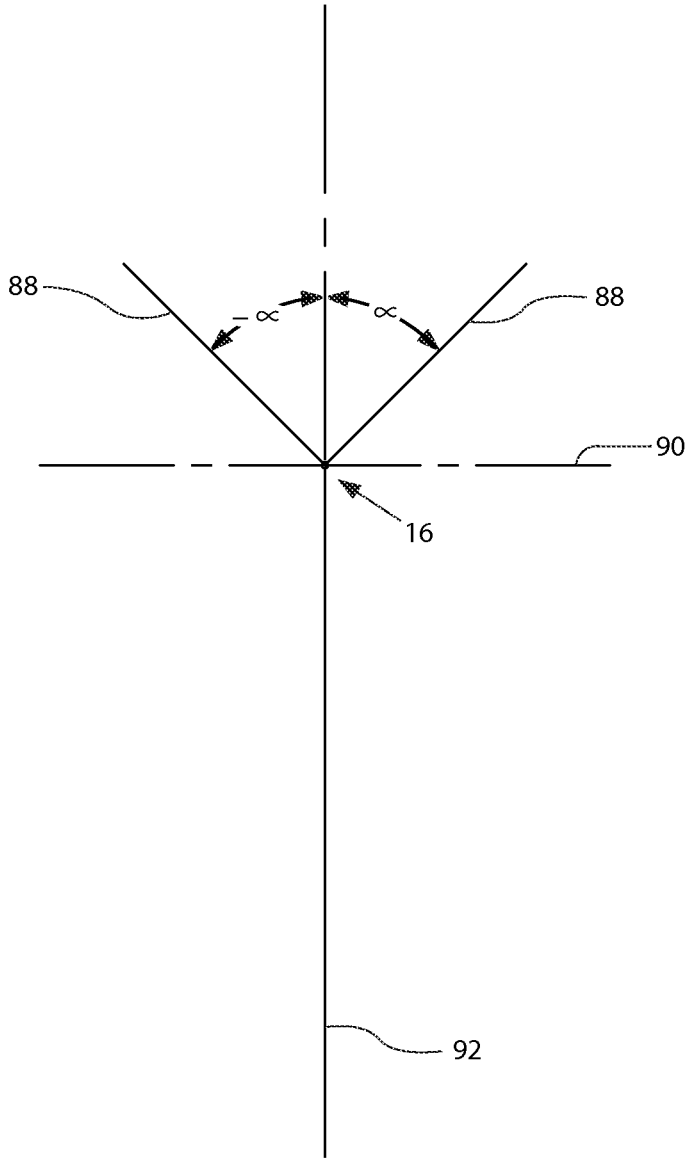
FIG. 10 is a diagrammatic representation of the articulation angle formed between longitudinal axes of the scraper of FIG. 9.

FIGS. 1 and 9 illustrate an elevating wheel tractor scraper 10 having a tractor portion 11, with a front frame section 12, and a scraper portion 13, with a rear frame section 14, that are pivotally coupled through articulation hitch 16. Steering may be provided by steering cylinders 32 (actuators) mounted between the tractor portion 11 and scraper portion 13 on opposing sides of the machine. As shown in FIG. 9, a top view of an exemplary scraper, the steering cylinders or actuators 32 may move the tractor portion 11 (and front frame section 12) relative to the scraper portion 13 (and rear frame section 14) to control an articulation angle $\alpha,-\alpha$ (FIG. 10). As demonstrated in FIG. 10, the articulation angle $\alpha,-\alpha$ is thus defined as the angle formed between a first longitudinal axis 88 of the tractor portion 11 and a second longitudinal axis 92 of the scraper portion 13, which are aligned in FIG. 9 ($\alpha,-\alpha$ equals 0 degrees). The machine 10 may allow for an articulation angle $\alpha,-\alpha$, for example, of up to 90 degrees in opposing directions, wherein $\alpha,-\alpha$ equals +90,−90 degrees, respectively, when the first axis 88 is aligned with transverse axis 90.

The front frame section 12 supports a cooling system (not shown) and power source 20, the power source 20 operatively connected through a transmission 22 (FIG. 2) to drive front wheels 24 for primary propulsion of the scraper 10. The front frame section 12 may also support an operator station 18 for primary control of the scraper 10 during ordinary operations.

The rear frame section 14 may support the bowl 28 and rear wheels 26. The bowl 28 may also include a fluid powered work tool 30, such as an elevator 52 (shown), auger, conveyor, or spade, to facilitate penetration and/or loading of the material to be transported.

Power source 20 may include an engine such as, for example, a diesel engine, a gasoline engine, a gaseous fuel powered engine such as a natural gas engine, or any other type of engine apparent to one of skill in the art. Power source 20 may alternatively include a non-combustion source of power such as a fuel cell, a power storage device, an electric motor, or other similar mechanism.

Figure 2:
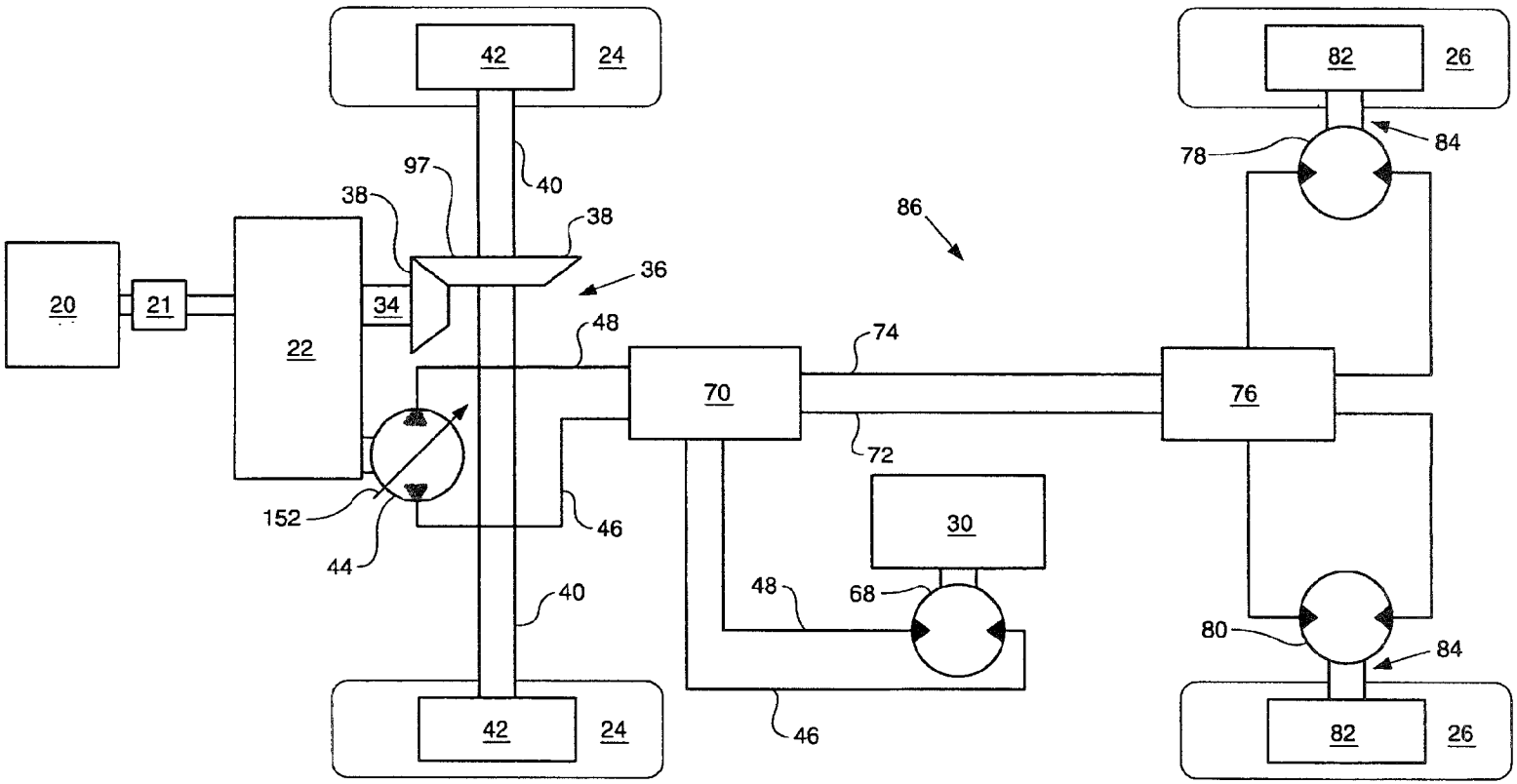
FIG. 2 is a diagrammatic representation of a power train and rear wheel assist system in accordance with one embodiment of the present disclosure.

As shown in FIG. 2, power source 20 may be operatively connected to front wheels 24 through a conventional transmission 22. The transmission 22 may be configured to transmit power from power source 20 to an output shaft 34 at a range of output speed ratios. Transmission 22 may be a hydraulic transmission, mechanical transmission, a hydromechanical transmission, an electric transmission, or any other suitable transmission known in the art. Alternatively, transmission 22 may transmit power from power source 20 at only a single output speed ratio. Transmission 22 may be connected to the power source 20 via a torque converter 21, gear box, or in any other manner known in the art. Transmission 22 may include an output shaft 34 operatively coupled through a transfer case or differential 36 having one or more gears 38 to transmit power through an axle shaft 40 to driven wheels 24 located on the left and right side of the scraper 10. Scraper 10 may also include a final drive reduction gear arrangement 42 associated with the axle shaft 40.

In an alternative embodiment (not shown), scraper 10 may include an electric or hydraulic drive (not shown). For example, power source 20 may be operatively connected to a pump, such as a variable or fixed displacement hydraulic pump. The pump may produce a stream of pressurized fluid directed to one or more motors associated with front wheels 24 for the primary means of propulsion. Alternatively, power source 20 may be drivably connected to an alternator or generator configured to produce an electrical current used to power one or more electric motors for driving the front wheels 24.

In addition to driving the front wheels 24, power source 20 may be configured to supply power to a work tool 30 employed by the scraper to penetrate and/or transfer material into bowl 28. In one embodiment, shown in FIG. 2, the transmission 22 is connected to a pump 44, which may be a variable displacement, variable delivery, fixed displacement, or any other pump configuration known in the art. While depicted as connected through the transmission 22, pump 44 may be connected to the power source 20 directly, to the torque converter 21, or at any desirable location along the powertrain. Pump 44 is fluidly connected through one or more supply and/or return lines 46,48 to supply a flow of pressurized fluid to hydraulic motor 68 operatively connected to power work tool 30. Throughout the specification, use of the terms supply and return in the alternative, or shown as "supply/return" should be understood to refer to the fact that the system may include a reversible pump that may be employed to change the direction of flow within particular conduits, in one direction acting as a supply, and in the other acting as a return line.

Figure 5:
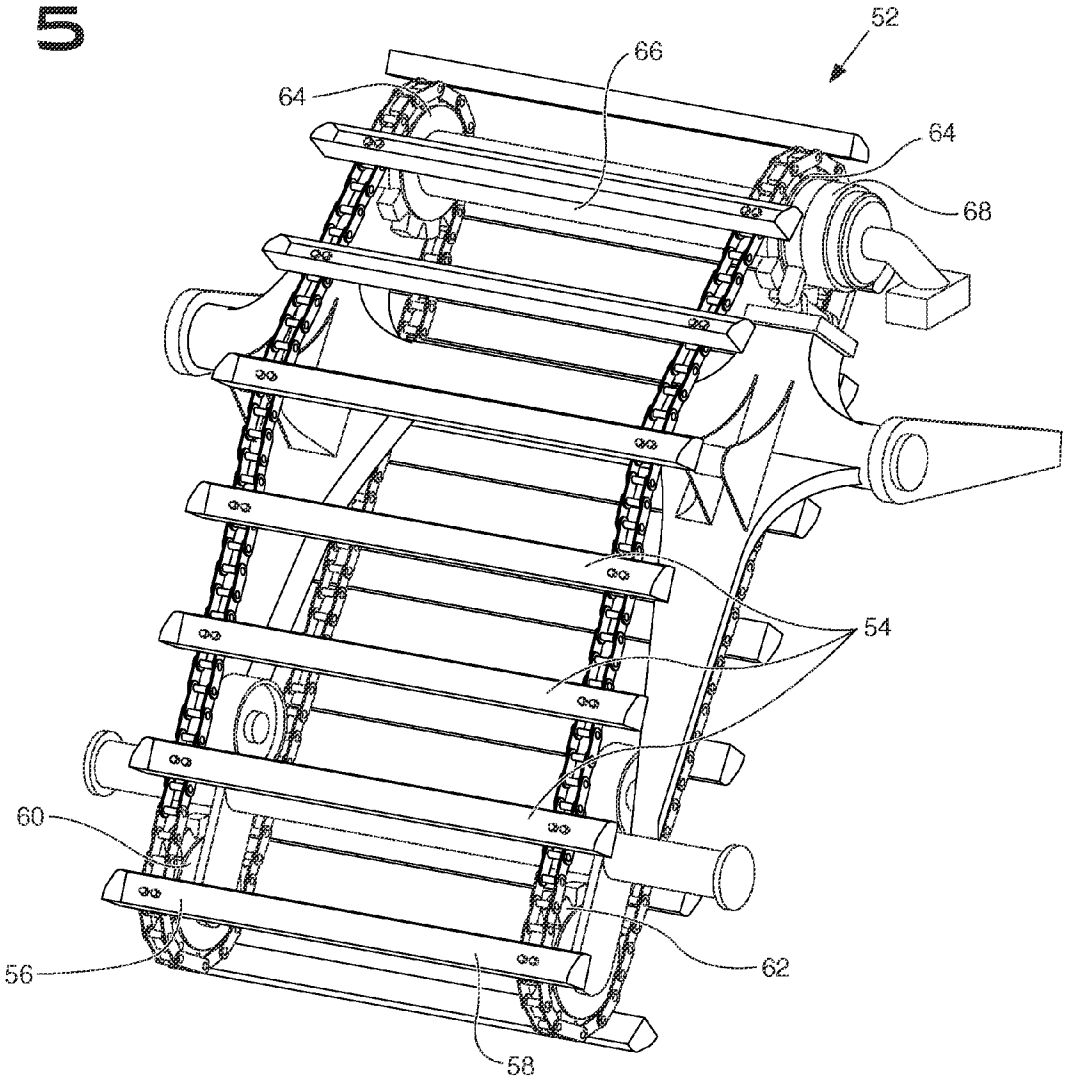
FIG. 5 is an illustration of an exemplary elevator.

In one embodiment, work tool 30 is an elevator 52 such as that depicted in FIG. 5. The elevator 52 generally includes a series of parallel, horizontally disposed flights 54, each flight 54 having a first end 56 and second end 58 connected to a first 60 and second 62 drive chain, respectively. The drive chains 60,62 are operatively connected to rotational sprockets 64 connected to elevator drive shaft 66 and elevator motor 68.

In certain operating conditions where, for example, mud, ice or snow, cause the primary driven wheels 26 of the scraper 10 to lose traction and/or the machine becomes stuck, the scraper 10 may be provided with a fluid operated rear wheel drive assist 86 that may be engaged manually or automatically. Referring to FIG. 2, the rear wheel drive assist 86 generally includes a diverter valve 70 disposed along the supply/return lines 46,48 between the pump 44 and work tool motor 68 to divert the flow of pressurized fluid to first and second supply/return lines 72,74. Supply/return lines 72,74 are fluidly connected to a flow divider 76 to direct flow between right and left drive motors 78,80. As with the front wheels 24, a final drive reduction 82 may be provided between the motors 78,80 and the rear wheels 26. Clutches 84 may be configured for selective engagement between the motors 78,80 and the final drives 82.

Figure 3:
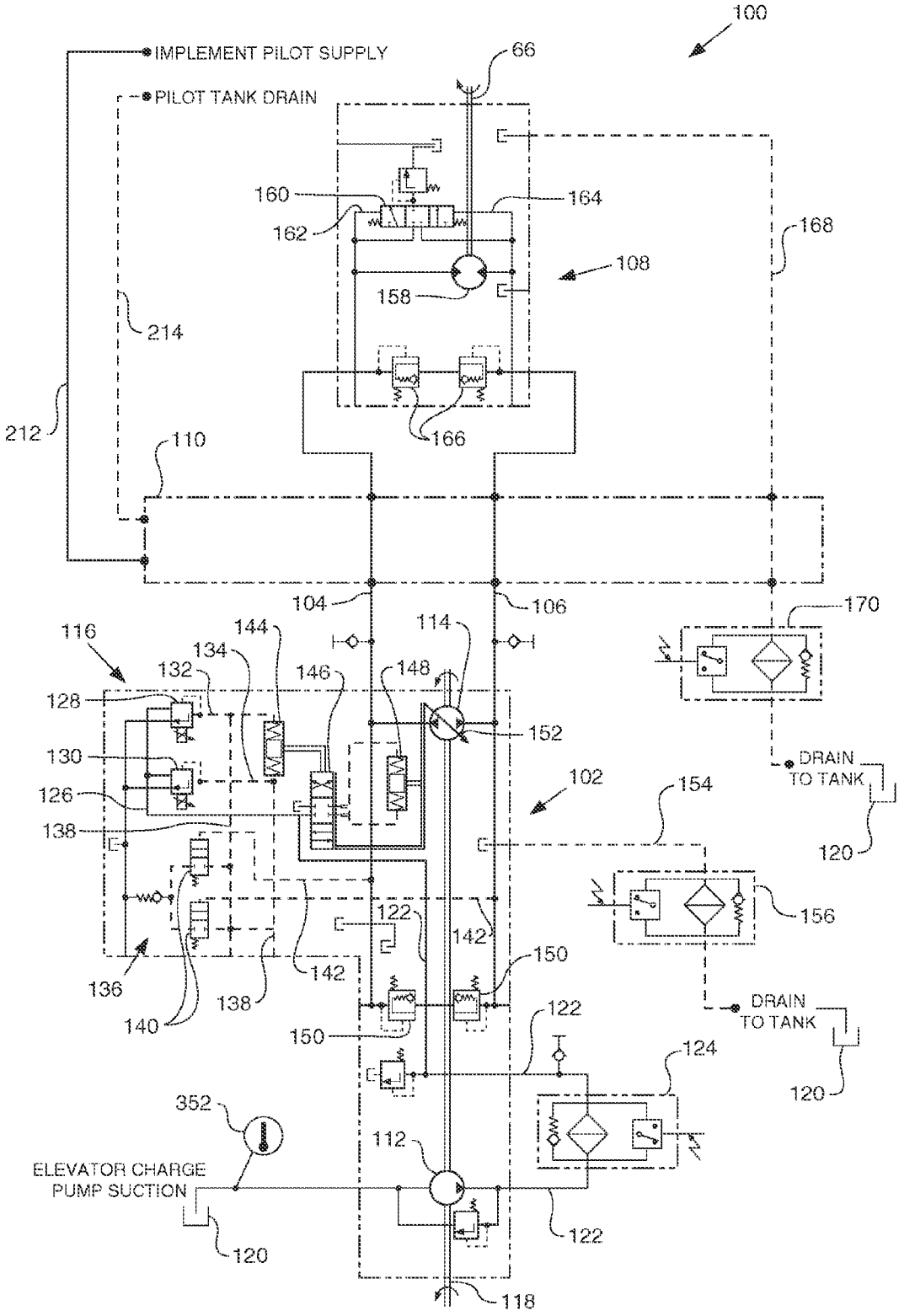
FIG. 3 is a schematic of an exemplary fluid operated system in accordance with one embodiment of the present disclosure.

FIG. 3 demonstrates one embodiment of an elevator and rear wheel drive assist closed-loop hydraulic system 100. The hydraulic system 100 generally includes the main elevator pump assembly 102 fluidly connected through forward supply/return line 106 and reverse supply/return line 104 to elevator motor assembly 108. Disposed along lines 104/106 between the elevator pump assembly 102 and elevator motor assembly 108 is the rear wheel assist assembly 110, shown in detail in FIG. 4.

The Pump Assembly 102 generally includes a charge pump 112, main pump 114, filters 124, 156, and a main pump control group 116, the charge pump 112 and main pump 114 being driven by shaft 118 operatively connected to the power source 20. Charge pump 112 is fluidly connected to fluid reservoir 120 to deliver a flow of pressurized fluid through charge line 122 and in-line charge filter 124 to control line 126. Disposed along control line 126 are forward and reverse solenoid control valves 128,130 that open to provide fluid flow along actuator control lines 132,134, respectively.

Actuator control lines 132,134 can be pressurized to control movement of swashplate spool actuator 144, which is mechanically linked to control the position of the three-way swash plate control spool 146. Swash plate control spool 146 is both mechanically linked to main swash plate actuator 148 and provides pressure from control line 126 to further provide movement of main actuator 148. Swash plate actuator 148 is mechanically linked to the swash plate 152 of variable displacement pump 114.

The actuator control lines 132, 134 are fluidly connected to max pressure control group 136 through pressure relief lines 138. Pressure relief lines 138 are connected to two-position pressure relief valves 140 that are controlled by pressure transmitted along relief valve control lines 142 connected to forward 106 and reverse 104 supply/return lines, respectively. Cross-over relief valves 150 are also provided to relieve pressure from forward 106 and reverse 104 supply/return lines, further protecting the pump assembly 102 from excessive pressure build-up. A case drain 154 is provided for the pump group 102 that includes a filter 156 fluidly connected to tank 120.

The elevator motor assembly 108 is fluidly connected to the elevator pump assembly 102 through forward and reverse supply/return lines 106,104. Lines 104,106 provide pressurized fluid to drive bi-directional elevator motor 158 that is operatively connected to elevator drive shaft 66 for rotation thereof. A pressure-actuated 3-position flushing valve 160 is fluidly connected to both the supply/return lines 104,106. Flushing valve 160 is controlled via pressure communicated from either of supply/return lines 104,106 via flushing valve control lines 162,164, respectively. Flushing valve 160 (pictured in closed orientation) can be opened to allow fluid from either supply/return lines 104,106 to drain to tank 120. Also provided to relieve pressure within motor assembly 108 are cross-over relief valves 166. Fluid from motor assembly 108 leakage and/or flushing valve 160 may drain to tank 120 via drain line 168 and through filter 170.

Figure 4:
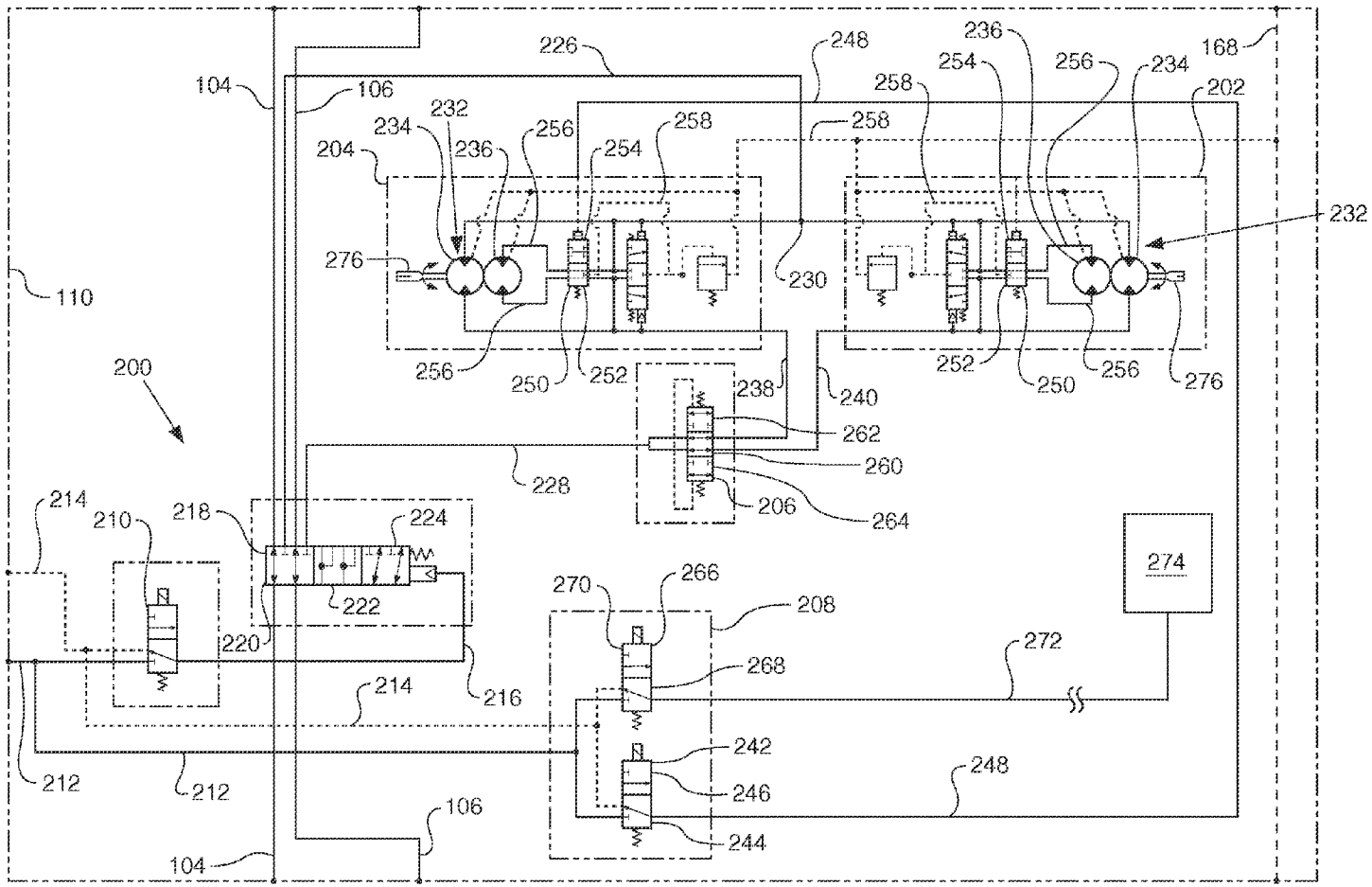
FIG. 4 is an enlarged view of a portion of the fluid operated system of FIG. 3.

FIG. 4 is an enlarged portion of system 100 (FIG. 3), illustrating one embodiment of a rear wheel assist assembly 110. Rear wheel assist assembly 110 generally includes a diverter 200, right drive motor assembly 202, left drive motor assembly 204, limited slip valve 206, and motor control group 208. The diverter 200 includes a two-position solenoid actuated control valve 210 that is connected to a pilot supply line 212 and pilot drain line 214. In the energized position, flow is directed from pilot supply line 212 along diverter valve control line 216 to diverter valve 218. Diverter valve 218 may be a pressure actuated three-way valve that in a first position (shown) 220 allows unrestricted flow through main supply/return lines 104,106 to the elevator motor assembly 108. In a second position 222, flow from pump 102 is divided between both elevator motor assembly 108 and right and left drive motor assemblies 202,204, along motor supply/return lines 226,228. In a third position 224, flow from pump 102 is completely diverted to the drive motor assemblies 202, 204. Second position 222 is a transition position that provides for momentary sharing of flow between the motor assemblies 202,204 and elevator motor assembly 108. Accordingly, diverter valve 218 is ordinarily in either the first 220 or third 224 position. Alternatively, diverter valve 218 may be a two-way valve that includes only first position 220 and third position 224.

Motor supply/return line 226 is split at junction 230 between the right and left motor assemblies 202,204. Motor assemblies 202,204 each include a two-stage radial motor 232 having a first stage 234 and a second stage 236 that correspond to a first and second fixed displacement (not shown). For example, the motor assemblies 202, 204 may include a rotary two stage motor such as the ML series motor by Poclain Hydraulics, France, that include a series of radial pistons that can be moved between a first and second position to modify pump displacement. The motor supply/return line 226 is fluidly connected to directly drive the first stage 234, which is also fluidly connected to supply/return lines 238, 240.

The second stage 236 of the right and left motor assemblies 202,204 is engaged or disengaged via motor control group 208. The motor control group 208 includes a motor speed control valve 242 that is controlled via an electrical signal that may be dependent upon, for example, vehicle speed, transmission output speed and/or a transmission output speed ratio. Upon energizing, the motor speed control valve 242 may move between a first, closed position 244 and a second, open position 246, in which flow is directed from pilot supply line 212, along motor stage control line 248 to actuate second stage control valves 250. As shown, motor speed control valve 242 is normally spring biased in the closed position 244.

As shown, second stage control valves 250 are spring biased in an open configuration (shown), first position 252, that allows pressurized fluid from supply/return lines 226, 238, 240 to flow to motor second stage 236 through second stage control lines 256. The pressurized fluid supplied via control lines 256 moves one or more pistons (not shown) within the rotary pump to increase pump displacement. Primary flow is directed into the pump along supply/return lines 226,238,240. When pressure from control line 248 overcomes the spring bias of valves 250, the valves 250 are moved to a second position 254 that directs the second stage control lines 256 to drain lines 258, causing the pistons to move to a second position and decrease overall pump displacement.

Disposed between supply/return line 228 and supply/return lines 238,240 is a pressure-responsive valve 206 that provides a limited slip function between the left and right motor assemblies 202,204. When one of the rear wheels 26 is slipping, this creates a low pressure condition at the associated motor assembly as there is less resistance and pressure build up associated with the spinning wheel. Pressurized fluid naturally flows to the less resistive, low pressure motor assembly, decreasing power available to the wheel with traction. The limited slip function serves to restrict flow to the motor assembly associated with the slipping wheel, and increase flow to the motor associated with the wheel with traction. More specifically, under equal pressure conditions, valve 206 is spring-biased in a first position 260 (shown) that distributes flow equally to the left and right drive motor assemblies 202,204. If a predetermined pressure differential exists between lines 238 and 240, valve 206 will shift to restrict flow to the lower pressure line.

Figure 8:
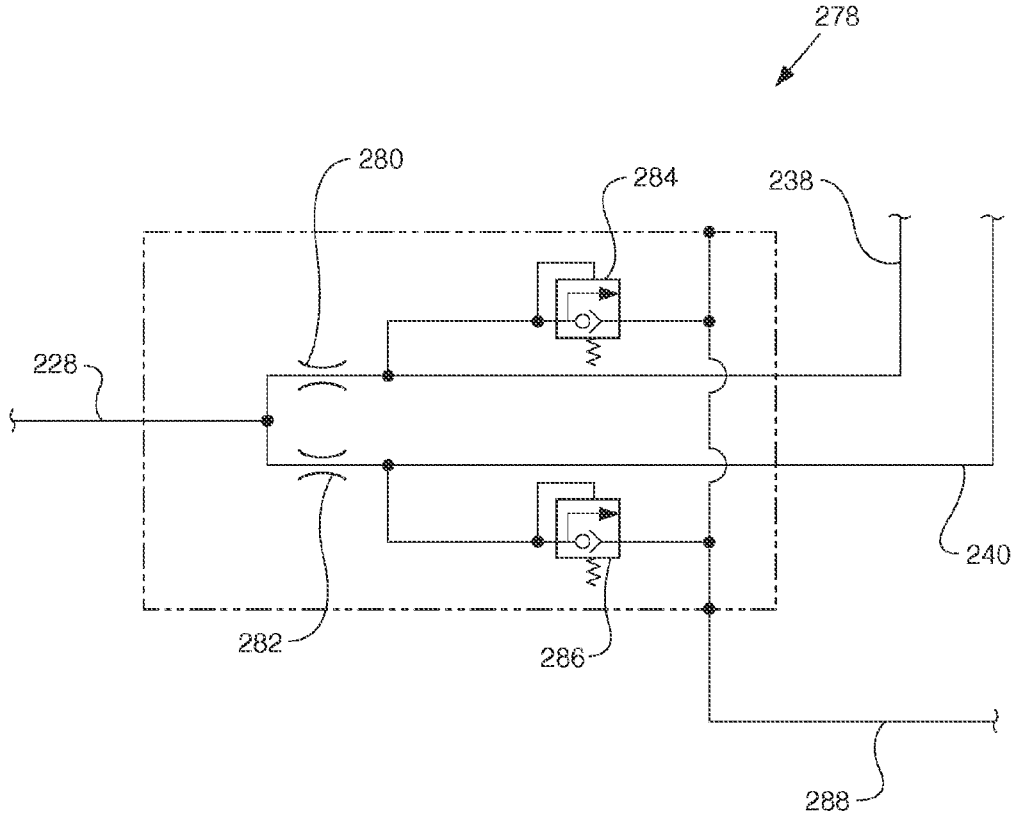
FIG. 8 is an alternative configuration to the limited slip function valve depicted in FIG. 4.

In an alternative embodiment to valve 206, shown in FIG. 8, provided is a flow control arrangement 278. Flow from motor supply/return line 228 is divided and passes through restrictors 280,282 that serve to partially equalize flow to/from supply/return lines 238,240. In the event that one wheel is stuck, creating a high pressure condition associated with one or both of supply/return lines 238,240, spring-actuated pressure relief valves 284,286 can provide a fluid connection to drain line 288 to tank.

In yet another embodiment, motor control group 208 may also include a clutch control valve 266. This solenoid controlled, two-position valve 266 is normally spring biased in a closed, first position 268 that opens clutch control lines 272 to drain line 214. In this position, the clutch assembly 274 is disengaged, allowing the wheels to spin freely relative to motor output shafts 276. When energized to a second position 270, clutch control line 272 may be pressurized to engage clutch assembly 274, connecting output shafts 276 to drive the rear wheels. In another embodiment, a similar valve arrangement (not shown), either alone or in combination with the clutch assembly 274, may be employed to engage a brake assembly associated with, for example, the output shafts 276 or final drives 82.

Figure 6:
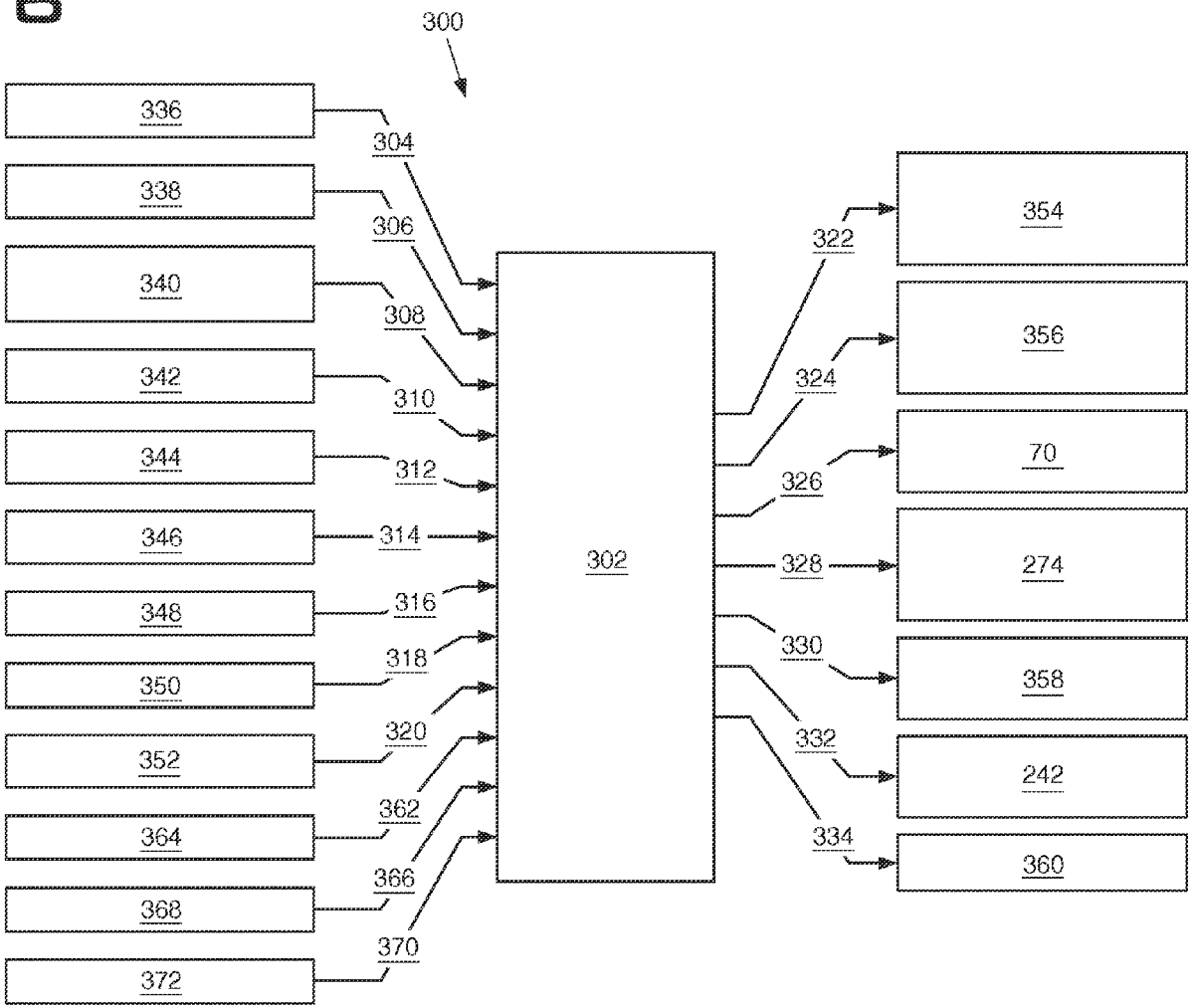
FIG. 6 is a diagrammatic representation of a control system for a rear wheel assist system in accordance with one embodiment of the present disclosure.

FIG. 6 is a diagrammatic representation of a control system 300 in accordance with one embodiment of a rear wheel assist of the present disclosure. Control system 300 generally includes a controller 302 configured to receive various signals 304-320, 362, 366, 370 from operator controls and/or machine sensors, and, based on these inputs, to produce control signals 322-334 for controlling operation of the rear wheel assist system 86. Controller 300 may embody a single microprocessor or multiple microprocessors that include a means for controlling numerous machine functions. Controller 300 may include a memory, a secondary storage device, a processor, and any other components for running an application. Various other circuits may be associated with controller 300, such as power supply circuitry, signal conditioning circuitry, solenoid driver circuitry, and others. Controller 300 may be dedicated to controlling the rear wheel assist system 86, or may be a unit for controlling multiple machine functions.

In particular, controller 302 may be configured to receive a motor speed signal 304,306 from a left and right motor speed sensor 336,338, respectively. Other machine input may include an engine speed signal 310 from an engine speed sensor 342 associated with power source 20; a front transmission condition signal 314 from, for example, a transmission sensor 346 or an operator transmission control mechanism (not shown), and indicative of, for example, a transmission gear ratio; a transmission output speed signal 312 from an output speed sensor 344 associated with, for example, output shaft 34; a hydraulic temperature signal 320 from a hydraulic fluid temperature sensor 352 associated with, for example, the hydraulic pump 44; and/or a front wheel speed signal 370 from one or more front wheel speed sensors 372 associated with one or both of the front wheels 24.

Controller 302 may also be configured to receive an articulation signal 362 from an articulation sensor 364, the articulation signal 362 being indicative of an angle of articulation $\alpha,-\alpha$ (FIG. 9). The Articulation angle $\alpha,-\alpha$ may detected using, for example, a linear position sensor disposed within or associated with one and/or both of steering actuators 32. For example, this may include a dual hall effect sensor disposed within each cylinder 32 that detects movement of the rod (not shown) therein. Where both cylinders 32 include a sensor, the signals 362 received may be used individually or compared to provide a more accurate indication of articulation angle.

In an alternative embodiment, the articulation sensor 364 may include one or more pivot angle sensors, such as a rotary dual hall effect PWM (Pulse Width Modulation) sensor associated with a pivot pin of articulation hitch 16. Other sensors 364, such as lasers, radar or cameras may also be employed. For example, a laser sensor may be employed to detect the relative position of the front frame section 12 relative to the rear frame section 14.

In addition, input may be received from various operator controls located, for example, in the operator station 18. These may include, for example, a rear wheel assist engagement signal 308 from a rear wheel assist control switch 340; a parking brake signal 316 associated with a parking brake control mechanism 348 indicative of engagement/disengagement of a parking brake (not shown); and/or a service brake signal 318 associated with a service brake control mechanism 350 and indicative of engagement/disengagement of the vehicle service brakes (not shown).

In yet another embodiment, in the place of or in addition to the various sensors 364, the controller 300 may be configured to receive a steering control signal 366 from an operator steering control 368, such as a joystick, steering wheel, or other known device the operator employs for steering the machine, and may thereby determine the angle of articulation $\alpha,-\alpha$. For example, if the operator employs the operating steering control 368 to command the steering actuators 32 to turn the machine left 15 degrees, this same signal may be employed to indicate the corresponding articulation angle $-\alpha$.

Controller 302 may be configured to control operation of the rear wheel assist system 86 through signals 322-334. These include, for example, forward and reverse pump control signals 322,324 for actuating pump forward and reverse control mechanisms 354,356, such as solenoid control valves 128,130 (FIG. 3), respectively. In addition, a diverter valve control signal 326 may be provided to control diverter valve 70,218, via, for example solenoid control valve 210; a clutch control signal 328 may be provided to control clutch 274 via, for example, solenoid control valve 266; a brake control signal 330 may be provided to control rear wheel or motor brakes 358; and/or a motor speed control signal 332 may be provided to control the speed condition of the left and right drive motor assemblies 202,204 via, for example, solenoid motor speed control valve 242.

Controller 302 may also be configured to communicate the status of the rear wheel assist system 86 to the operator via, for example, a status signal 334 operatively connected to one or more indicators 360, such as an indicator light located in the operator station 18. Alternatively, status signal 334 may be connected to an operator display screen, audible signal indicator, or any other type of indicator known in the art.

INDUSTRIAL APPLICABILITY

The present disclosure provides a wheel tractor scraper 10 that includes a rear wheel assist 86 for improving machine operations in poor traction conditions, thereby increasing machine efficiency and versatility to operate in a greater range of environmental, material and worksite conditions. In particular, provided is a fluid operated rear wheel drive assist 86 that employs a common pump 44 or pumps that are shared with a fluid powered work tool 30, such as an elevator 52, auger, conveyor or spade. When the system is engaged, fluid flow is diverted from the elevator motor 68 to one or more rear wheel drive motors 78,80. The operation of one embodiment of the disclosed rear wheel assist systems is explained in the paragraphs that follow.

Figure 7:
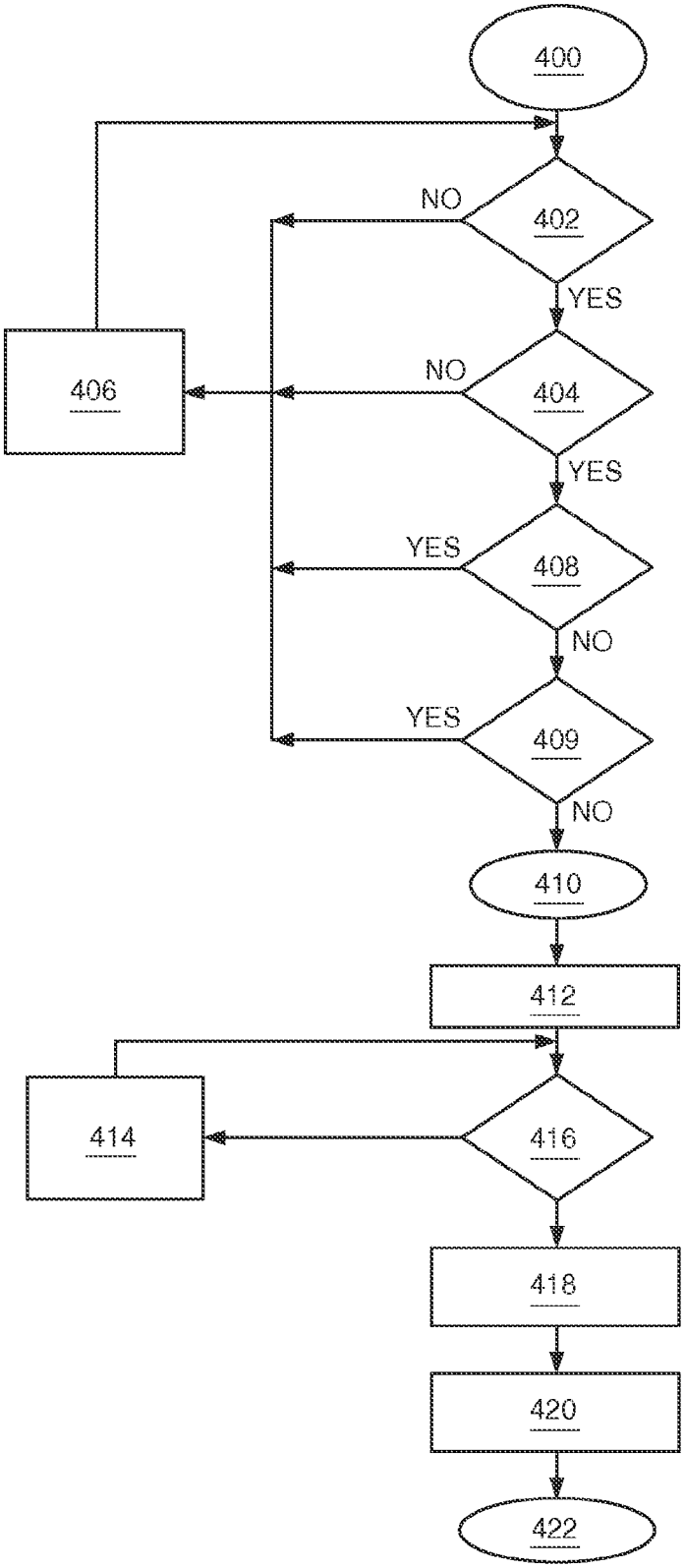
FIG. 7 is a flow chart illustrating a method of operation of a rear wheel assist system in accordance with one embodiment of the present disclosure.

Referring again to FIGS. 3-4, during loading operations, the operator may have engaged elevator pump assembly 102, the charge pump 112 and main pump 114 being powered by rotating drive shaft 118. Charge pump 112 provides a flow of pressurized fluid along charge line 122 to solenoid control valves 128, 130. To actuate the elevator 52, the operator may provide a signal through an operator control (not shown) that controls the magnitude and direction of flow from the variable displacement pump 114. For example, the operator may move the control to energize solenoid control valve 128, providing a flow of pressurized fluid along actuator control line 132, moving swash plate spool actuator 144 and connected main swash plate actuator 148 to control the position of swash plate 152. Activated pump 114 directs a flow of pressurized fluid in a forward direction along forward supply line 106 to elevator motor 158, which drives rotation of elevator drive shaft 66 in a forward direction. In this instance, fluid flow returns from the motor 158 along return line 104 to pump 114. The pump 114 may be operated similarly in a reverse direction via actuation of solenoid control valve 130. From this position, we now refer to the operational flow chart of FIG. 7.

When the operator determines that it is desirable to engage 400 the rear wheel drive assist, the operator may employ the rear wheel assist control switch 340 providing an engagement signal 308 to controller 302. The transmission 22 is capable of operation through a range of gear ratios and vehicle speeds. In one embodiment, the rear wheel assist 86 is designed to operate only at relatively low machine speeds, e.g. below 9 mph. This protects the motors and hydraulic system from overspeed conditions. Moreover, in one embodiment, the purpose of the system is to provide additional traction only when the vehicle becomes disabled due to poor traction conditions, and thus operation may be limited to lower gear ratio, high torque transmission conditions. Accordingly, the controller 302 is provided with a transmission condition signal 314 indicative of, for example, the current transmission gear for performing a transmission status check 402. During status check 402, if the transmission 22 is in the lowest gear ratios, for example, first to third gear, the system 300 proceeds to perform a hydraulic fluid temperature check 404. Otherwise, the rear wheel assist 86 is not engaged (or is disengaged) 406 until the condition is met. In an alternative embodiment, check 402 may be based on the current speed of the machine, as provided, for example, by one or more speed sensors (not shown) associated with the front axle shafts 40, final drives 42 or wheels 24.

The hydraulic fluid temperature check 404 is performed to prevent damage to the hydraulic system components. A temperature signal 320 is provided via one or more temperature sensors 352 associated with, for example, pump assembly 102, to controller 302. If the temperature is above, for example, 90 to 93 degrees Celsius (194 to 199.4 degrees Fahrenheit), the system will not engage (or is disengaged) 406 until the temperature condition is met.

The wheel tractor scraper 10 may include a parking brake, for example, a friction type brake associated with one or more elements of the powertrain, such as the power source 20 or transmission 22 output shafts 34. The controller 302 may be configured to receive a parking brake signal 316 and determine whether the parking brake is engaged or disengaged 408. In the embodiment shown, the rear wheel assist will not engage (or will disengage) 406 if the parking brake is engaged.

Once the controller 302 has determined that the above conditions have been met, the controller 302 will engage the rear wheel assist 410. To engage the rear wheel assist, the controller may provide a diverter valve control signal 326 to diverter valve 70 (FIG. 2) transferring the flow of pressurized fluid from the work tool 30 to rear wheel motors 78,80. More specifically, referring to FIG. 4, diverter valve control signal 326 may be employed to energize solenoid control valve 210, moving the two position valve to direct flow from pilot supply 212 along diverter valve control line 216 to shift diverter valve 218 to third position 224. Thus positioned, pressurized flow is directed from forward supply/return lines 106,104 along motor supply/return lines 226,228 to left and right drive motor assemblies 202,204.

In one embodiment, the rear wheel drive assist 86 may also include a clutch 84,274 configured to mechanically engage or disengage the left and right drive motor assemblies 202,204 from the rear final drives 82 or wheels 26. Controller 302 may provide a clutch control signal 328 to energize solenoid control valve 266, moving from first position 268 to second position 270, thereby creating flow between pilot supply 212 and clutch control line 272 to engage the clutch 274, transferring power from the motor assemblies 202,204 to drive rear wheels 26.

"Disengaged" or "disengaging the system" refers generally to any condition in which power is not supplied to the rear wheels. As described, this may be accomplished by, for example, interrupting pressurized flow to the rear motor assemblies 202,204, or disconnecting the motor assemblies 202,204 from driving the rear wheels 26, alone or in combination. Disengagement may also include shutting down pressurized flow from pump assembly 202.

Also at step 410, the system 300 may signal the operator that the rear wheel assist has been engaged via status signal 334 directed to a rear wheel assist indicator 360, such as an indicator light, display, and/or audible alert. Generally, this will alert the operator when he has employed the control switch 340 that power is not being supplied to drive the rear wheels due to some other operating condition that must be met.

The control system 300 is also configured to control the amount of power supplied to drive the rear wheels 26. This is generally accomplished by controlling operation of the pump assembly 102 and motor assemblies 202,204 in response to various machine and or operator inputs.

More specifically, at step 412 the control system 300 may be configured to modify pump displacement to match the current front transmission output ratio or gear. The controller 302 is configured to receive a transmission condition signal 314 indicative of, for example, the current output ratio or gear selection, and to modify displacement of main pump 114 based thereon. For example, in first to second gear, the main pump 114 may be upstroked to provide a higher flow rate and pressure than in third gear. The controller 302 may be configured to send a pump forward control signal 322 to pump forward control mechanism 354, such as solenoid valve 128 to increase the displacement of pump 114. While shown in FIG. 7 as occurring after engagement of the rear wheel assist 410, matching of pump displacement 412, it should be understood that this process may occur before or after engagement 410.

Typically, the wheel tractor scraper 10 will include service brakes (not shown), such as conventional wet or dry friction brakes, employed to slow or stop the scraper 10 during ordinary operations. Conventional service brakes may be actuated via an operator control, such as a foot pedal, disposed within the operator station 18. When the brakes are employed 416, it may be desirable to disengage 414 the rear wheel assist 86 to reduce the amount of force required to slow the vehicle and to avoid damage to the rear wheel assist 86 components. At step 416, the controller 302 is configured to receive a service brake signal 318 indicative of the status of the service brakes 350, and to thereafter disengage 414 if the service brakes have been engaged. Brake signal 318 may be associated with the degree of movement of a brake pedal (not shown) such that over a first portion of movement thereof, for example, over the first 15 percent of total movement, there is a "deadband" period over which the rear wheel assist 86 remains engaged. When the control pedal moves past 15 percent, the controller 302 is configured to disengage 414 the rear wheel assist 86.

The rear wheel assist control system 300 may also include a closed loop wheel speed control 418 that is generally employed to modify displacement of the main pump 114 to approximately match front 24 and rear 26 wheel speeds (or an average thereof). The purpose of this feature is to provide increased power to drive the rear wheels 26 in the event that the front wheels 24 are slipping, and vice versa.

In one embodiment, the controller 302 is configured to receive a signal indicative of the speed of the front wheels 24. For example, controller 302 may be configured to receive a transmission output speed signal 312 that is employed by the controller 302 to calculate an approximation of the average front wheel speeds 26. The scraper 10 may include a front differential such that the right and left wheel speeds may be independently variable. Accordingly, the transmission output speed signal 312 provides an estimation of average front wheel 24 speeds. Alternatively, sensors (not shown) associated with the front axle shafts, final drives, or wheels may provide a signal indicative of actual front wheel speed. In addition, the power source speed, provided by a power source sensor 342 via signal 310 could also be employed in combination with the transmission output speed signal 312. The front wheel speeds provided to or derived by the controller 302 are employed to control displacement of the pump 44 to control speed of the rear wheel drive motors 78,80 and associated rear wheels 26.

The controller 302 is also configured to receive an indication of rear wheel 26 speeds from right and left motor speed sensors 336,338 via right and left motor speed signals 304, 306. The feedback to the control system 300 is determined by the average of the rear wheel 26 speeds as determined by the controller 302. A speed error signal is determined from the difference between the average front and rear wheel speeds, which is received by a proportional-integral (PI) controller. The PI controller is configured to bring the speed error signal to zero by adjusting the commands to the pump 44 (increasing or decreasing pump displacement accordingly) to attempt to match front and rear wheel speeds.

For example, if the machine is loading, with only the front driven wheels 24 engaged, and the machine becomes stuck, the average front wheel speed could be spinning at, for example, 10 mph, and the rear wheel speed would be zero. The rear wheel assist is engaged, and the pump 44 will stroke up to make the rear motors 78,80 rotate the rear wheels 26 at the same speed as the front wheels 24. Because of efficiency losses and calibration errors associated with the hydrostatic system, transmission output speed signal 312 and/or rear wheel speed determination by the controller, the pump command 322 may not initially match the front and rear wheel speeds. The closed loop speed control will then produce an error and command the pump 44 to increase displacement even higher until the front and rear wheel speeds are approximately equal (speed error equals zero).

As shown in FIGS. 9-10, the steering of the articulated machine 10 employs right and left steering actuators 32 connected between the front frame section 14 and rear frame section 14 to control the angle of articulation $\alpha$,$-\alpha$. However, with the rear wheel assist 86 engaged, as the articulation angle $\alpha$ increases, or $-\alpha$ decreases, (as the front and rear frame sections move towards one another), if traction to the front wheels 24 is insufficient, the machine may be driven forward rather than turning. This may also cause the front end of the machine to "hop" when the front wheels catch or regain traction. The result of these conditions is decreased machine control and undesirable stresses on, for example, the articulation hitch 16, actuators 32, and other machine components. These effects may be amplified at greater machine travel speeds.

Therefore, to improve operations, the control system 300 may be configured to modify operation of the rear wheel assist 86 based on the degree of articulation of the machine 10 and/or based on machine travel speed. For example, an articulation-based control 420 (FIG. 7) may be provided that employs one or more articulation sensors 364 to provide an indication of articulation angle $\alpha$,$-\alpha$ and modulate power to the rear wheels 26, by, for example, controlling the pump 44, diverter valve 70, motors 78,80, clutch 84 and/or brakes.

In one embodiment, controller 302 is configured to receive an articulation signal 362 from an articulation sensor 364, for example, from linear hall effect sensors associated with steering actuators 32. The positional information provided by the linear sensors is employed to provide an indication of articulation angle $\alpha$,$-\alpha$. When separate sensors are employed for both the left and right cylinders 32, the signals can be used individually or in concert to provide further accuracy.

Controller 302 is also configured to receive an indication of both front and rear wheel speeds. For example, the controller may determine an average rear wheel speed from left and right motor speed signals 304,306. The front wheel speed may be determined as an average of the front wheel speeds provided by left and right front wheel speed sensors 372. Alternatively, controller 302 may be configured to receive a transmission output speed signal 312 that is employed by the controller 302 to calculate an approximation of the average front wheel speeds 26. Further, speed sensors associated with the front axle shafts, final drives, or other drive train components may also provide a signal indicative of actual front wheel speeds. In addition, the power source speed, provided by a power source sensor 342 via signal 310 could also be employed in combination with the transmission output speed signal 312.

Based on the indication of articulation angle 362 and front and rear wheel speeds, the controller 302 may modulate the output to rear wheels 26 to improve machine control. That is, controller 302 may be configured to provide pump control signals 322,324, a diverter valve control signal 326, clutch control signal 328, brake control signal 330, and/or motor speed control signal to modulate rear wheel speed by a factor provided, for example, by way of an algorithm, look-up table, or map. For example, shown in Table 1 is a range of articulation angles α,−α with corresponding changes in rear wheel speed, expressed as the average rear wheel speed as a percentage of average front wheel speed. This is further exemplified in FIG. 11, which is a graphical representation of the modification shown in Table 1.

TABLE I

| Steering Angle (degrees) | Average Rear Wheel Speed as percentage of Average Front Wheel Speed (%) |
|---|---|
| −90 | 19.08 |
| −85 | 28.27 |
| −80 | 36.2 |
| −70 | 51 |
| −60 | 64 |
| −50 | 76.6 |
| −40 | 85.8 |
| −30 | 93 |
| −20 | 97.75 |
| −10 | 99.8 |
| 0 | 100 |
| 10 | 99.8 |
| 20 | 97.75 |
| 30 | 93 |
| 40 | 85.8 |
| 50 | 76.6 |
| 60 | 64 |
| 70 | 51 |
| 80 | 36.2 |
| 85 | 28.27 |
| 90 | 19.08 |

Figure 11:
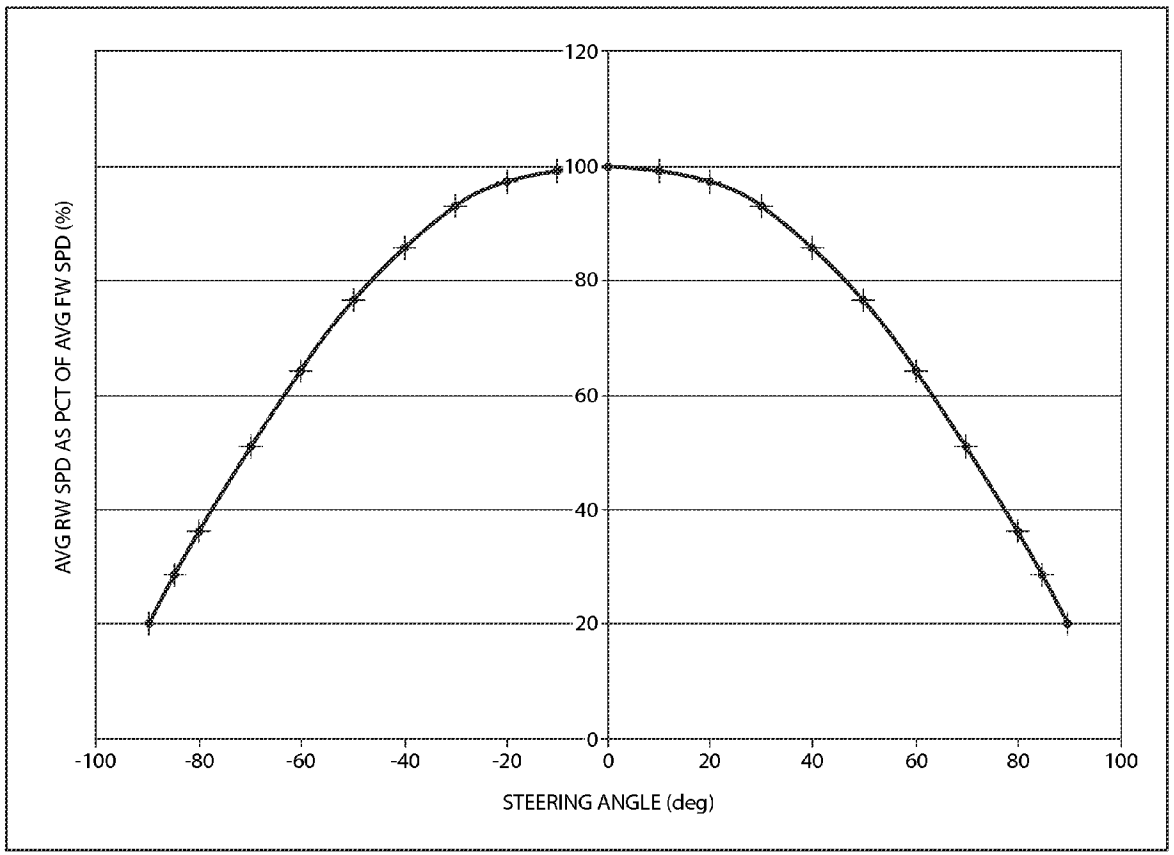
FIG. 11 is a graphical representation of rear wheel speed modulation based on articulation angle.

As illustrated in FIG. 11, when the longitudinal axis of the front frame section is aligned with the longitudinal axis of the rear frame section, at α,−α equals zero degrees, the rear wheel speed is not modified, the average front and rear wheel speeds being equal (100%). However, as the angle increases, for example at approximately α,−α equals 60,−60 degrees, the rear wheel speed is reduced to operate at 64 percent. At approximately α,−α equals 90 degrees (potentially the maximum articulation angle allowable by the machine), the rear wheel speed is decreased to less than 20 percent. In another embodiment, there may be a range of articulation angles, for example, between 0 and 25 degrees, over which no corresponding modification in rear wheel speed is provided. Alternatively, there may be a range of articulation angles, for example, beyond α,−α equals 60,−60 degrees, wherein the rear wheel speed is decreased by a maximum desired factor of, for example, 20 percent.

As the travel speed of the machine 10 increases, the negative effects in terms of decreased machine control and potential damage may be amplified. Accordingly, in yet another embodiment, the machine travel speed, as determined, for example, by front wheel speed sensor 372 and/or output shaft speed sensor 344, may also be employed by the controller 302, in combination with articulation angle, to modify rear wheel speed. For example, below a desired travel speed, for example, 5 mph, the controller may not modulate rear wheel speed, regardless of articulation angle. As machine speed increases, for example, from 5 to 9 mph, the controller 302 may increase the average rear wheel speed percentage above the corresponding reductions illustrated in Table I. For example, at a maximum operating speed of the rear wheel assist (e.g., 9 mph), all of the percentages may be increased by a fixed amount or by some additional percentage. For example, at approximately α, −α equals 90 degrees, instead of modifying rear wheel speed to approximately 19% of average front wheel speed, at 9 mph, the rear wheel speed is decreased to approximately 25% of average front wheel speed. A "machine speed signal indicative of machine travel speed" may be provided by the same front and rear speed sensors discussed above. For example, front wheel speed sensors 372, transmission sensor 246, and rear wheel speed sensors 336, 338 could all be employed, alone or in combination, to provide an indication of machine travel speed. Other methods of providing an indication of machine travel speed, such as, for example, via radar, lasers, or GPS, should be known to those of skill in the art.

In yet another embodiment, in place of or in addition to the above rear wheel speed modifications, the system 300 may include an initial check 409, wherein prior to engaging 410 the rear wheel assist 86, the controller 302 determines whether the articulation angle α,−α is greater than a desired threshold, for example, wherein a is above 60 degrees, or −α is beyond −60 degrees, and, if the condition is met, prevents engagement 410 of the rear wheel assist.

In connection with the articulation angle control 420, the determinations are made based on an "indication of" articulation angle. The term "indication of" or "indicates" refers to the fact that the system may make determinations by calculating an articulation angle α,−α, based on, for example, signals provided by the various articulation sensors discussed herein, or by employing such signals without actually converting the data into a numeric value of degree. For example, the system could employ as the articulation sensor a laser sensor that determines a distance between the front frame section 12 and rear frame section 12. In this case, the distance provides an "indication" of the articulation angle, but does not actually employ a calculation thereof. In another example, a linear sensor may provide a signal indicative of actuator position that is mapped against a reduction in rear wheel speed. Again, this provides an "indication of" articulation angle α,−α, but does not provide calculation thereof. Numerous other methods for providing an indication of articulation angle that can be employed to modulate output to the rear wheels 26 should be apparent to those of skill in the art in view of this disclosure.

Finally, at step 422, once the operator determines that the rear wheel drive assist is no longer necessary, the operator may turn off the rear wheel assist 86 via control switch 340, de-energizing the solenoid control valve 210, which is spring biased to direct flow from control line 216 along pilot drain line 214 to tank. This shifts diverter valve 218 back to first position 220, re-directing flow from pump assembly 102 to the elevator motor assembly 108.

It should be understood that the above description is intended for illustrative purposes only. In particular, it should be appreciated that all methods described herein can be performed in any suitable order unless otherwise indicated herein or otherwise clearly contradicted by context.

While aspects of the present disclosure have been particularly shown and described with reference to the embodiments above, it will be understood by those skilled in the art that various additional embodiments may be contemplated by modification of the disclosed machines, systems and methods without departing from the spirit and scope of what is disclosed. Such embodiments should be understood to fall within the scope of the present invention as determined based upon the claims below and any equivalents thereof.

What is claimed is:

1. An articulated machine, comprising:

a first frame section having a power source drivingly connected to at least one front wheel, the first frame section further having a first longitudinal axis;

a first wheel sensor configured to provide an indication of a front wheel speed;

a second frame section having at least one rear wheel and a second longitudinal axis, the first and second frame sections pivotally connected at an articulation hitch;

an articulation sensor configured to provide an articulation signal indicative of an articulation angle between first and second longitudinal axes; and a rear wheel drive assist providing a power output to the at least one rear wheel, comprising:

at least one drive motor operatively connected to the at least one rear wheel; and a controller communicatively coupled to the first wheel sensor and the articulation sensor and configured to:

determine a desired rear wheel speed based on the articulation signal, the desired rear wheel speed being less than the front wheel speed; and modulate the power output to the at least one rear wheel based upon the desired rear wheel speed.

2. The articulated machine of claim 1, further including opposed first and second linear actuators connected between the first frame section and the second frame section and configured to move the first frame section relative to the second frame section about the articulation hitch.

3. The articulated machine of claim 2, wherein the articulation sensor is a linear sensor associated with the first or second actuators.

4. The articulated machine of claim 1, wherein the articulation sensor is a rotary sensor associated with the articulation hitch.

5. The articulated machine of claim 1, in which the drive motor is powered by a fluid pump, in which the controller is operably coupled to the drive motor and the fluid pump, and in which the controller modulates the power output to the at least one rear wheel by controlling at least one of the pump or the drive motor.

6. The articulated machine of claim 1, further including:

a work tool pump fluidly connected to a fluid operated work tool motor operatively connected to power a work tool, the rear wheel drive assist further including a diverter valve having at least a first position at which fluid flow is delivered from the work tool pump to the work tool motor and a second position at which fluid flow is diverted from the work tool pump to the drive motor, wherein the controller is operatively coupled to the diverter valve and is further configured to deliver a diverter control signal to move the diverter valve between the first position and the second position.

7. The articulated machine of claim 6, wherein the controller modulates the power output to the at least one rear wheel by controlling at least one of a position of the diverter valve, a clutch between the drive motor and the at least one rear wheel, the work tool pump, the drive motor, or a brake associated with the at least one rear wheel.

8. The articulated machine of claim 1, in which the controller is further configured to receive a machine speed signal indicative of a machine travel speed, and in which the controller determines the desired rear wheel speed based on both the articulation signal and machine speed signal.

9. The articulated machine of claim 8, wherein the machine speed signal is at least one of a transmission output speed signal or a front wheel speed signal.

10. The articulated machine of claim 8, wherein the controller reduces the power output to the at least one rear wheel in response to an increasing articulation angle and an increasing machine speed.

11. The articulated machine of claim 10, wherein the indication of front wheel speed is provided by at least one of a front wheel speed sensor or a transmission output speed sensor.

12. The articulated machine of claim 1, wherein the controller is configured to receive an indication of front wheel speed and rear wheel speed, and to reduce the rear wheel speed relative to the front wheel speed as the articulation angle increases.

13. An articulated machine, comprising:

a first frame section having a power source drivingly connected to at least one front wheel, the first frame section further having a first longitudinal axis;

a second frame section having at least one rear wheel and a second longitudinal axis, the first and second frame sections pivotally connected at an articulation hitch;

an articulation sensor configured to provide an articulation signal indicative of an articulation angle between first and second longitudinal axes;

a first speed sensor configured to provide an indication of a front wheel speed;

a second speed sensor configured to provide an indication of a rear wheel speed; and a rear wheel drive assist providing a power output to the at least one rear wheel, comprising:

at least one drive motor operatively connected to the at least one rear wheel; and a controller communicatively coupled to the first wheel sensor and the articulation sensor and configured to:

determine a desired rear wheel speed based on the articulation signal, the desired rear wheel speed being less than the front wheel speed; and modulate the power output to the at least one rear wheel by reducing the rear wheel speed relative to the front wheel speed based on the desired rear wheel speed.

14. The articulated machine of claim 13, wherein the controller is provided with a first articulation angle range over which the rear wheel speed relative to the front wheel speed is not altered based on articulation angle.

15. The articulated machine of claim 14, wherein the first articulation angle range is between an articulation angle of zero and a desired articulation angle.

16. The articulated machine of claim 13, further including a machine speed sensor configured to provide an indication of machine travel speed, in which the controller determines the desired rear wheel speed based upon a combination of articulation angle and machine travel speed.

17. The wheel tractor scraper of claim 13, wherein the controller is configured to calculate the articulation angle based on the articulation angle signal, and to compare the calculated articulation angle to a set of articulation angle values with corresponding rear wheel speed reduction factors.

18. A wheel tractor scraper, comprising:

a tractor portion having a power source drivingly connected to at least one front wheel, the tractor portion having a first longitudinal axis;

a scraper portion pivotally connected to the tractor portion at an articulation hitch, the scraper portion having a second longitudinal axis, a bowl and at least one rear wheel;

first and second linear actuators connected between the tractor portion and the scraper portion in opposed position, the first and second actuators configured to move the tractor portion relative to the scraper portion about the articulation hitch;

an articulation sensor configured to provide an articulation signal indicative of an articulation angle between the first and second longitudinal axes;

a first speed sensor configured to provide an indication of a front wheel speed;

a second speed sensor configured to provide an indication of a rear wheel speed; and a hydraulic rear wheel drive assist providing a power output to the at least one rear wheel, comprising:

a fluid pump fluidly connected to at least one fluid drive motor, the fluid drive motor operatively connected to the at least one rear wheel; and a controller communicatively coupled to the first wheel sensor and the articulation sensor and configured to:

determine a desired rear wheel speed based on the articulation signal, the desired rear wheel speed being less than the front wheel speed; and modulate the power output to the at least one rear wheel by reducing the rear wheel speed relative to the front wheel speed based on the desired rear wheel speed.

19. The wheel tractor scraper of claim 18, wherein the first speed sensor is configured to monitor a transmission output speed, a transmission output speed ratio, an axle speed, or a wheel speed to provide an indication of a front wheel speed.

20. The wheel tractor scraper of claim 18, wherein the controller modulates the power output to the at least one rear wheel by controlling at least one of the fluid pump or the drive motor.

* * * * *